US010755846B2

(12) United States Patent
Cheon et al.

(10) Patent No.: US 10,755,846 B2
(45) Date of Patent: Aug. 25, 2020

(54) TRANSFORMER AND POWER SUPPLY APPARATUS INCLUDING THE SAME

(71) Applicant: SOLUM Co., Ltd., Yongin-si (KR)

(72) Inventors: Myeong-sik Cheon, Suwon-si (KR); Jun-young Kim, Suwon-si (KR); Yun-sic Bang, Uiwang-si (KR)

(73) Assignee: SOLUM Co., Ltd., Yongin-si (KR)

( * ) Notice: Subject to any disclaimer, the term of this patent is extended or adjusted under 35 U.S.C. 154(b) by 152 days.

(21) Appl. No.: 15/977,430

(22) Filed: May 11, 2018

(65) Prior Publication Data

US 2019/0027293 A1 Jan. 24, 2019

(30) Foreign Application Priority Data

Jul. 21, 2017 (KR) ..... 10-2017-0092602

(51) Int. Cl.
*H01F 27/24* (2006.01)
*H01F 27/28* (2006.01)
(Continued)

(52) U.S. Cl.
CPC ..... *H01F 27/24* (2013.01); *H01F 27/2804* (2013.01); *H01F 27/292* (2013.01);
(Continued)

(58) Field of Classification Search
CPC ..... H01F 2005/046; H01F 2005/043; H01F 27/24; H01F 27/2804; H01F 27/325; H01F 27/292; H01F 27/324; H01F 27/027; H01F 27/288; H01F 27/36; H01F 27/362; H01F 2017/008; H01F 2027/297; H01F 2027/2809; H01F 2027/2819
(Continued)

(56) References Cited

U.S. PATENT DOCUMENTS 5,949,321 A * 9/1999 Grandmont ..... H01F 17/0006 336/200
6,914,508 B2 * 7/2005 Ferencz ..... H01F 27/266 29/602.1
(Continued)

FOREIGN PATENT DOCUMENTS

JP 2002-75737 A 3/2002
KR 10-1123996 B1 3/2012
(Continued)

OTHER PUBLICATIONS

Office Action dated May 9, 2018 by the Korean Intellectual Property Office in counterpart Korean Patent Application No. 10-2017-0092602.
(Continued)

*Primary Examiner* — Mang Tin Bik Lian
(74) *Attorney, Agent, or Firm* — Sughrue Mion, PLLC

(57) ABSTRACT

A transformer includes a magnetic core having an inner space, a coil unit disposed within the magnetic core and including a primary coil and a secondary coil in which layers formed with conductive patterns are laminated, and a base configured to receive the magnetic core and the coil unit. A portion of the base is inserted into and disposed in the coil unit to be interposed between an output terminal coupled to the secondary coil and the magnetic core.

14 Claims, 5 Drawing Sheets

(51) Int. Cl.
*H01F 27/29* (2006.01)
*H01F 27/32* (2006.01)
*H01F 27/02* (2006.01)

(52) U.S. Cl.
CPC ..... *H01F 27/324* (2013.01); *H01F 27/325* (2013.01); *H01F 27/027* (2013.01); *H01F 2027/2809* (2013.01); *H01F 2027/2819* (2013.01); *H01F 2027/297* (2013.01)

(58) Field of Classification Search
USPC ..... 336/220, 200, 180, 192, 83, 84 R, 84 C, 336/221, 212
See application file for complete search history.

(56) References Cited

U.S. PATENT DOCUMENTS 8,310,327 B2 * 11/2012 Willers ..... H01F 27/06 336/200
9,536,651 B2 * 1/2017 Li ..... H01F 27/2804
2007/0152795 A1 7/2007 Zeng et al.
2009/0295528 A1 * 12/2009 Silva ..... H01F 3/10 336/200
2013/0099885 A1 * 4/2013 Park ..... H01F 27/2804 336/170
2015/0279547 A1 * 10/2015 Park ..... H01F 27/2804 361/770
2017/0032888 A1 * 2/2017 Park ..... H01F 27/2847

FOREIGN PATENT DOCUMENTS

KR 10-2015-0026761 A 3/2015
KR 10-1590132 B1 2/2016

OTHER PUBLICATIONS

Communication dated Nov. 29, 2018, issued by the European Patent Office in counterpart European Patent Application No. 18172240.6.

* cited by examiner

TRANSFORMER AND POWER SUPPLY APPARATUS INCLUDING THE SAME

CROSS-REFERENCE TO RELATED APPLICATIONS

This application claims priority from Korean Patent Application No. 10-2017-0092602, filed on Jul. 21, 2017, in the Korean Intellectual Property Office, the disclosure of which is incorporated herein by reference in its entirety.

BACKGROUND OF THE INVENTION

Field of the Invention

Apparatuses and methods consistent with exemplary embodiments relate to a transformer, and more particularly, to a transformer and a power supply apparatus including the same.

Description of the Related Art

A power unit may be provided in a power supply apparatus and a transformer in the power unit may have a size corresponding to approximately one third of a total size of the power unit.

The transformer may be an electronic component widely used to adjust an alternating current (AC) voltage in the power supply apparatus and may have a structure that a primary coil and a secondary coil are wound around a bobbin and a core is integrally coupled to the center.

The transformer may generate an induced electromotive force in the secondary coil through power applied to the primary coil. A magnitude of the induced electromotive force of the secondary coil may be adjusted according to a voltage applied to the primary coil and a turn ratio of the first and secondary coils.

There is a burden of winding the coil around the core or the bobbin in manufacturing and a limit of part miniaturization in the conventional transformer.

The manufacturing process of the transformer may be complicated due to space security for a necessary creepage distance between the coil and the core or the requirement of the safety standards.

SUMMARY OF THE INVENTION

Exemplary embodiments may overcome the above disadvantages and other disadvantages not described above. Also, an exemplary embodiment is not required to overcome the disadvantages described above, and an exemplary embodiment may not overcome any of the problems described above.

One or more exemplary embodiments relate to a transformer capable of implementing miniaturization and improving assemblability and productivity and a power supply apparatus including the same.

One or more exemplary embodiments relate to a transformer capable of exhibiting good insulation performance between a magnetic core and a coil through an insertion coupling structure of a coil unit and a base, achieving miniaturization while sufficiently securing a creepage distance between the magnetic core and an output terminal, and manufacturing the transformer through simple assembly.

According to an aspect of an exemplary embodiment, there is provided a transformer including a magnetic core having an inner space; a coil unit disposed within the magnetic core and including a primary coil and a secondary coil in which layers formed with conductive patterns are laminated; and a base configured to receive the magnetic core and the coil unit. A portion of the base may be inserted into and disposed in the coil unit to be interposed between an output terminal coupled to the secondary coil and the magnetic core.

The coil unit may include a first part including the output terminal; a second part including a pattern part formed with the conductive patterns and an input terminal coupled to the primary coil; and a slit configured to separate the first part and second part.

The base may include a seating part in which the magnetic core and the coil unit are placed and at least one sidewall formed to protrude from the seating part. The sidewall may include an insertion part inserted into and coupled to the slit.

A height of the insertion part may be formed higher than a height of the magnetic core.

The insertion part may form a present creepage distance between the output terminal and the magnetic core.

The slit may be formed to be curved to a direction of the first part.

The insertion part may be formed as a portion of the sidewall.

The coil unit may further include a groove formed apart from the slit.

The sidewall may further include a coupling part fitting-coupled to the groove.

The coil unit may further include an auxiliary coil for forming an induced current.

The conductive patterns of the primary coil may be disposed in an upper side and a lower side of the conductive pattern of the secondary coil.

According to an aspect of an exemplary embodiment, there is provided a power supply apparatus including a transformer which includes a magnetic core having an inner space; a coil unit formed within the magnetic core and including a primary coil and a secondary coil in which layers formed with conductive patterns are laminated; and a base configured to receive the magnetic core and the coil unit, wherein a portion of the base is inserted into and disposed in the coil unit to be interposed between an output terminal coupled to the secondary coil and the magnetic core; and a main substrate mounted with the transformer.

According to a transformer and a power supply apparatus including the same according to an exemplary embodiment, a creepage distance between a magnetic core and an output terminal may be sufficiently secured.

A manufacturing process may be simplified through an insertion coupling structure of a base and a coil unit and a size and manufacturing cost of the transformer may be reduced.

Additional aspects and advantages of the exemplary embodiments are set forth in the detailed description, and will be obvious from the detailed description, or may be learned by practicing the exemplary embodiments.

BRIEF DESCRIPTION OF THE DRAWING FIGURES

The above and/or other aspects of the present invention will be more apparent by describing certain exemplary embodiments of the present invention with reference to the accompanying drawings, in which.

DETAILED DESCRIPTION OF THE EXEMPLARY EMBODIMENTS

Figure 1:
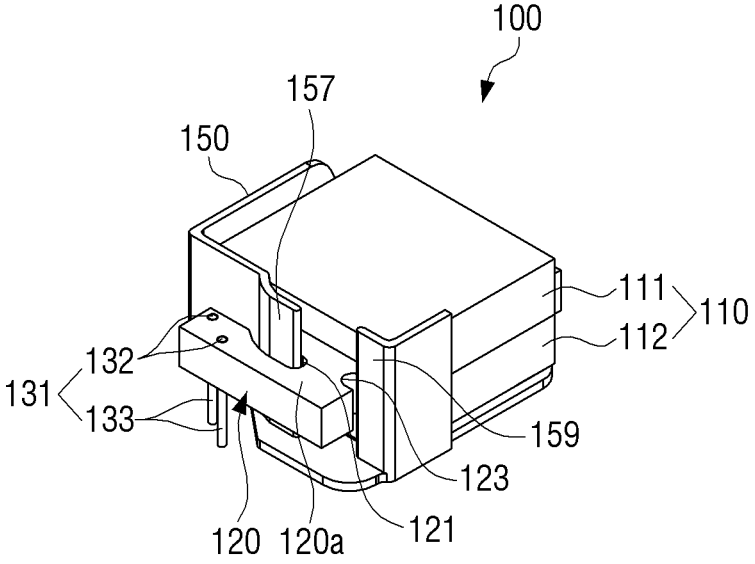
FIG. 1 is a perspective view illustrating a transformer according to an exemplary embodiment.

Hereinafter, various embodiments will now be described more fully with reference to the accompanying drawings in which some embodiments are shown. The techniques described herein are exemplary, and should not be construed as implying any particular limitation on the present disclosure. However, in the following description, it is understood that the technology described therein may not be limited to a specific embodiment, and various modifications, equivalents, and/or alternatives of the embodiments may be included therein without departing from the principles and spirit of the present disclosure.

In the following description, unless otherwise described, the same reference numerals are used for the same elements when they are depicted in different drawings.

Figure 2:
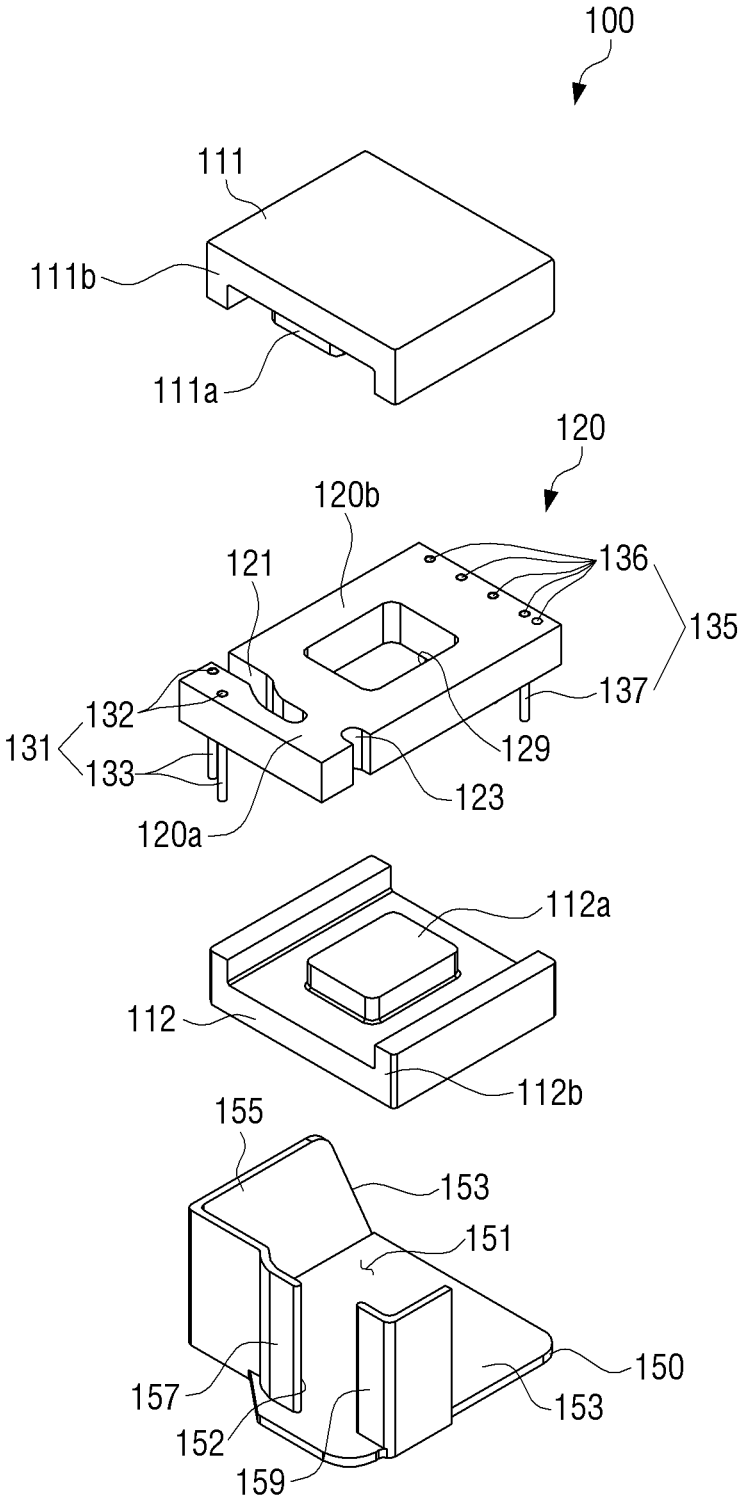
FIG. 2 is an exploded perspective view illustrating a transformer according to an exemplary embodiment.
Figure 3:
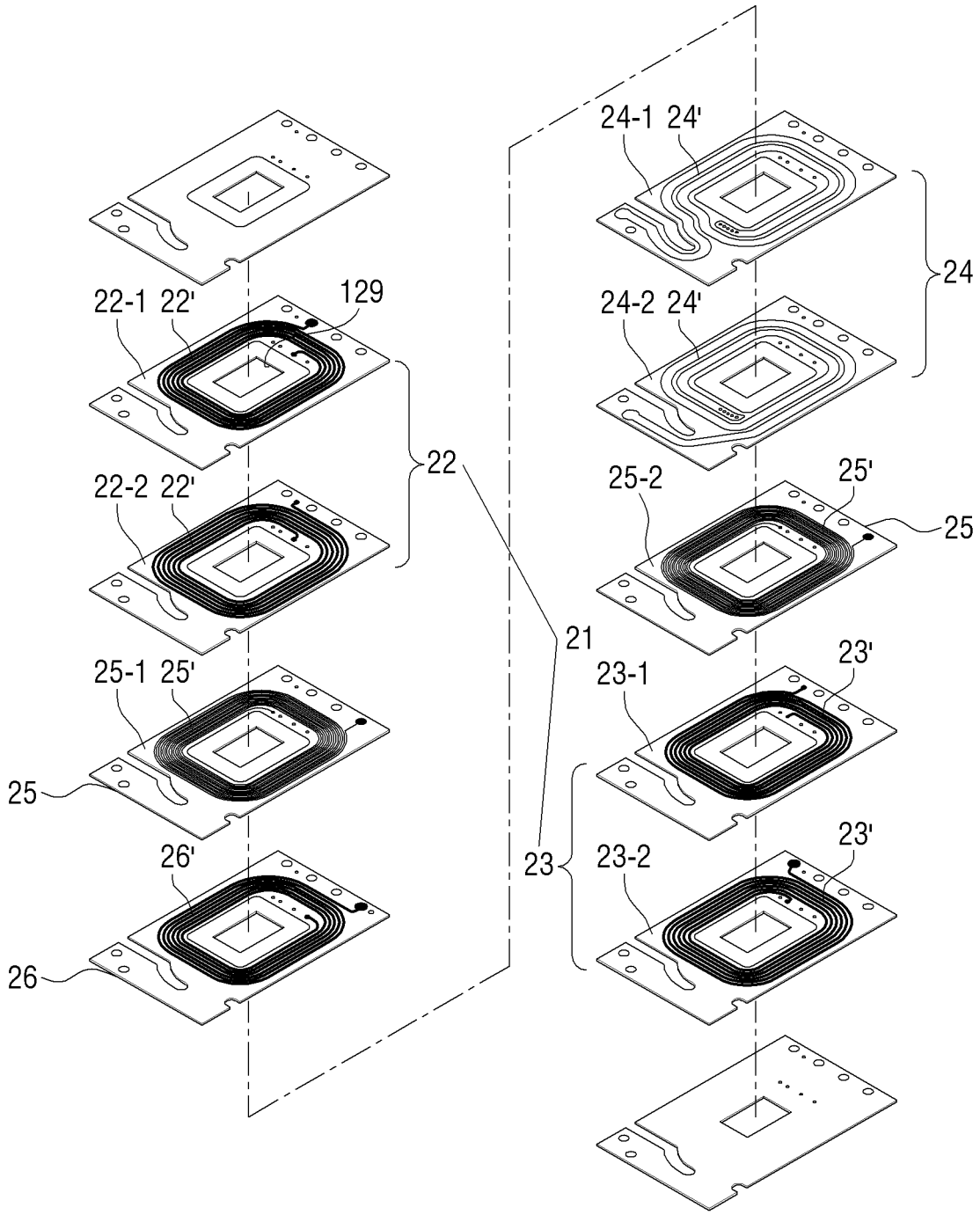
FIG. 3 is an exploded perspective view illustrating layers laminated in a coil unit according to an exemplary embodiment.

FIGS. 1 and 2 are a perspective view and an exploded perspective view illustrating a transformer according to an exemplary embodiment. FIG. 3 is an exploded perspective view illustrating layers laminated in a coil unit according to an exemplary embodiment.

Referring to FIGS. 1 to 3, a transformer 100 according to an exemplary embodiment may be a large-power and large-current transformer mounted on a power supply apparatus and may be configured to include a magnetic core 110, a coil unit 120, and a base 150.

The coil unit 120 may be disposed in the inside of the magnetic core 110 and the magnetic core may form a magnetic path electromagnetically coupled to the coil unit 120.

The magnetic core 110 may include an upper core 111 formed with a space between a middle foot 111*a* and an outer foot 111*b* and a lower core 112 having a middle foot 112*a* and an outer foot 112*b* corresponding to the upper core 111. The coil unit 120 to be described later may be disposed in an inner space between the upper core 111 and the lower core 112. The middle feet of the magnetic core 110 may be inserted into a through hole 129 formed in the center of the coil unit 120 and the upper core 111 and the lower core 112 may be coupled to be in contact with each other. The upper core 111 and the lower core 112 may be coupled to form one magnetic core 110.

It has been illustrated that the magnetic core 110 is an E-shaped core having an E-shaped preset cross-section, but this is not limited thereto. For example, the magnetic core 110 may be configured of an E-I magnetic core, an I-I magnetic core, and the like.

The magnetic core 110 may be formed of a Mn—Zn ferrite having high permeability, low loss, high saturation magnetic flux density, stability, and low production cost as compared with other materials. However, the shape and material of the magnetic core 110 in the exemplary embodiment are not limited thereto.

The coil unit 120 may constitute the primary and/or secondary coils of the transformer 100 and when the coil unit 120 is assembled to the magnetic core 110 and power is applied to the primary coil coupled to an external power supply, the power induced through the secondary coil may be supplied to a circuit coupled to the transformer 100 and used in an apparatus such as a power supply apparatus which has to change the commercial power and supply the changed power.

The coil unit 120 may include a primary coil 21 in which a plurality of layers 22-1 and 22-2 formed with conductive patterns 22' and a plurality of layers 23-1 and 23-2 formed with conductive patterns 23' are laminated and a secondary coil 24 in which a plurality of layers 24-1 and 24-2 formed with conductive patterns 24' are laminated. The primary coil 21 may be configured of a laminating board including an inductor pattern having the predetermined number of turns in which the plurality of thin layers 22-1 and 22-2 and 23-1 and 23-2 formed with the conductive patterns 22' and 23' are laminated.

The secondary coin 24 may be configured of a laminating board including an inductor pattern having the predetermined number of turns in which the plurality of thin layers and 24-1 and 24-2 formed with the conductive pattern 24' are laminated.

The primary coil 21 and the secondary coil 24 may be integrally formed to be formed as one multi-layered printed circuit board (PCB). The forming figure of the layers in the PCB will be described later.

The transformer 100 according to an exemplary embodiment may considerably improve a manufacturing efficiency by forming the coil unit 120 with a mass-producible PCB.

The multi-layered PCB may have a structure that a plurality of layers having coil patterns are laminated and the coil patterns of the laminated layers are coupled through a via electrode and the like. The PCB including the primary coil and the secondary coil formed in the coil patterns may be formed to have a relatively low height.

The coil unit 120 may be configured of a PCB having a predetermined thickness and the coil unit 120 may be formed in a quadrangular plate shape. The through hole 129 into which the magnetic core 110 is inserted may be formed in the inside of the coil unit 120.

The coil unit 120 may include a pattern part in which the conductive patterns 22', 23', and 24' of the primary coil 21 and the secondary coils 24 formed on the basis of the through hole 129 are disposed. For example, the pattern part may refer to a central region of the coil unit 120.

An input terminal 135 which electrically couples the primary coil 21 to the outside may be formed in one side of the pattern part and an output terminal 131 which electrically couple the secondary coil 24 to the outside may be formed in the other side of the pattern part.

The PCB constituting the coil unit 120 may be formed to have a length in a longitudinal direction larger than a length of the magnetic core 110 in the longitudinal direction. Accordingly, the output terminal 131 may be formed in one end of the coil unit 120 drawn to a front of the magnetic core 110 and the input terminal 135 may be formed in the other end of the coil unit 120 drawn to a rear of the magnetic core 110.

The output terminal 131 and the output terminal 135 may be configured to electrically couple the primary coil 21 and the secondary coil 24 to external circuits and include via electrodes 132 and 136 which inner wall surfaces thereof are coated with a conductive material and pass through the board and terminal pins 133 and 137 inserted into the via electrodes 132 and 136. However, the input terminal 135 and the input terminal 131 are not limited thereto and may be variously modified to a component which may electrically couple the coil unit 120 and a main substrate (see 10 of FIG. 5), for example, a pad, a solder bumper, a solder ball, a connector, and the like.

The via electrodes 132 and 136 may be formed in starting points and end points of the conductive patterns 22' and 23' of the primary coil and the conductive pattern 24' of the secondary coil which are not coupled to each other. The terminal pins 133 and 137 may be inserted into the via electrodes 132 and 136 to electrically couple the conductive patterns.

The output terminal 131 and the input terminal 135 may be formed in positions spaced apart from each other and in the exemplary embodiment, the output terminal 131 may be formed in an opposite side of the input terminal 135.

The coil unit 120 may be divided into a first part 120*a* including the output terminal 131 and a second part 120*b* configured of the remaining portion. The coil unit 120 may include a slit 121 between the first part 120*a* and the second part 120*b*.

The first part 120*a* may include the output terminal 131 to which the secondary coil 24 is coupled and may refer to the portion of the coil unit 120 drawn to the front of the magnetic core 110.

The second part 120*b* may be the remaining portion of the coil unit 120 other than the first part 120*a*. For example, the second part 120*b* may include the pattern part in which the conductive patterns 22', 23', and 24' of the primary coil 21 and the secondary coil 24 are formed and the input terminal 135 to which the primary coil 21 is coupled.

The slit 121 may be formed to separate the first part 120*a* and the second part 120*b*. The slit 121 may be formed to have a fixed width and a portion of the base 150 to be described later may be inserted into and disposed in the slit 121.

The portion of the base 150 inserted into the slit 121 may be inserted and disposed between the first part 120*a* and the second part 120*b*. The inserted portion of the base 150 may be interposed between the magnetic core 110 and the output terminal 131 to isolate the magnetic core 110 and the output terminal 131. Through the structure that the portion of the base 150 inserted into and coupled to the slit 121 of the coil unit 120, the insulation distance and the creepage distance between the isolated magnetic core 110 and output terminal 131 may be secured.

The base 150 may be formed to include a coil assembly, in which the magnetic core 110 and the coil unit 120 are coupled, in the inside of the base 150 and may form an overall body of the transformer 100.

The base 150 may receive the magnetic core 110 and the coil unit 120 in an inner space 151 through an upper opening. The inner space 151 of the base 150 may include a seating unit 153, in which the coil assembly that the magnetic core 110 and the coil unit 120 are assembled is placed, and at least one sidewall 155 formed to surround the coil assembly.

A bottom of the seating part 153 may be a flat plate, but this is not limited thereto. The seating part 153 may be variously modified to include at least one hole for smooth heat emission in the inside or to be formed in a lattice or radial frame form.

The sidewall 155 may be formed along an outer circumferential surface of the base 150 and may be formed to protrude upward from the seating part 153. The inner space 151 may be configured as a space having a container form, which receives the assembly of the magnetic core 110 and the coil unit 120, through the seating part 153 and the sidewall 155.

The sidewall 155 may be disposed so that the front and the rear of the base 150 are opened. The base 150 may draw the front portion and the rear portion of the coil part 120 through front openings 152 and rear openings. The output terminal 131 to which the secondary coil 24 is coupled may be disposed in the drawn front portion of the coil unit 120 and the input terminal 135 to which the primary coil 21 is coupled may be disposed to the drawn rear portion of the coil unit 120.

The front portion of the coil part 120 drawn through the front opening 152 of the base 150 may correspond to the first part 120*a*. The output terminal 131 disposed in the first part 120*a* may be isolated from the magnetic core 110 disposed in the inner space 151 of the base 150 through the sidewall 155.

The sidewall 155 may be configured to protect the coil assembly in which the magnetic core 110 and the coil unit 120 are assembled and simultaneously to secure insulation between the coil assembly and other electronic parts mounted on the main substrate 10.

Accordingly, when the electronic parts are not disposed close to each other or the insulation security is not necessary, the sidewall in a corresponding direction may be omitted.

The sidewall 155 forming the outer circumferential surface of the base 150 may include at least one insertion part 157 which partitions a space of the coil unit 120. The output terminal 131 and the magnetic core 110 may be disposed in the spaces partitioned through the insertion part 157. The insertion part 157 may be disposed between the output terminal 131 and the magnetic core 110 and the insulation distance and the creepage distance between the output terminal 131 and the magnetic core 110 may be secured. The insertion part 157 may constitute a portion of the sidewall 155 and may be integrally formed with the sidewall 155.

The insertion part 157 may be formed to extend along a width of the base 150 and may extend to a position spaced at a fixed distance from an end of the base. Accordingly, the front opening 152 may be formed in the front of the base 150. The first part 120*a* disposed in an outer side of the base 150 and the second part 120*b* disposed in an inner side of the base 150 may be coupled through the front opening 152.

The insertion part 157 may be formed to have a width (or height) larger than a height of the magnetic core 110 disposed in the inner side of the base 150.

The insertion part 157 may be formed to be curved toward the outer side of the base 150. When the insertion part 157 is formed to be curved toward the first part 120*a*, a width of a portion in which the first part 120*a* and the second part 120*b* of the coil unit 120 are coupled may be further widely formed. Accordingly, the coupling portion of the first part 120*a* and the second part 120*b* may be prevented from being broken. As the first part 120*a* and the second part 120*b* are stably coupled, the coil unit 120 may be stably coupled to the base 150.

The insertion part 157 may be formed to have a size and a shape sufficient to be easily inserted into the slit 121 and simultaneously to prevent the coupled base 150 and coil unit 120 from being easily separated.

The insertion unit 157 may be disposed to pass through the slit 121 of the coil unit 120. An upper portion of the insertion part 157 may be disposed to pass through the coil unit 120 and to be exposed to the outside. The assembly of the magnetic core 110 and the coil unit 120 may be coupled to the base 150 and simultaneously the insertion part 157 may be inserted and disposed between the output terminal 131 and the magnetic core 110. Accordingly, the insulation distance and the creepage distance between the output terminal 131 and the magnetic core 110 may be easily secured.

The base 150 may be easily manufactured through injection molding, but this is not limited thereto. The example that the insertion part 157 is integrally formed with the base 150 is illustrated, but this is not limited thereto and the insertion part 157 may be separately formed from the base 150 as a separate member and may be configured to be coupled to the base 150. The base 150 according to an exemplary embodiment may be formed of an insulating resin and may be configured of a material having high heat resistance and high withstand voltage.

The coil unit 120 may further include a groove 123 spaced apart from the slit 121. The sidewall 155 of the base 150 may further include a coupling part 159 fitting-coupled to the groove 123. When the coil unit 120 and the base 150 are coupled, the coupling part 159 may be fitted to the groove 123 to stably couple the coil unit 120 and the base 150.

FIG. 3 is an exploded perspective view illustrating layers laminated in a coil unit according to an exemplary embodiment.

Referring to FIG. 3, the coil unit 120 may be formed of a PCB in which the plurality of layers 22-1 and 22-2 and 23-1 and 23-2 formed with the conductive patterns 22' and 23' constituting the primary coil and the plurality of layers 24-1 and 24-2 formed with the conductive pattern 24' constituting the secondary coil are laminated and coupled. The coil unit 120 may be configured of a conductive pattern formed of at least one or more layers. The layers may be a thin polymer plastic substrate, but the material of the layers is not limited to a specific material and any material having an insulation property may be used for the layers.

The primary coil 21 may be configured of the layers 22-1 and 22-2 and 23-1 and 23-2 which are formed with the conductive patterns 22' and 23' and are sequentially laminated and coupled to each other. The conductive pattern 22' and 23' may form the primary coil and may be electrically coupled to each other through a via electrode and the like. The conductive patterns 22' and 23' may be laminated to form a coil-shaped inductor pattern.

The conductive patterns 22' and 23' of the primary coil 21 may generate a magnetic path which generate electromagnetic induction. To form the magnetic path, the primary coil patterns 22' and 23' may be formed of a conductive material.

The primary coil 21 may include an upper primary coil 22 disposed in an upper side on the basis of the secondary coil 24 and a lower primary coil 23 disposed in a lower side on the basis of the secondary coil 24. It has been described in the exemplary embodiment that the primary coil includes the upper primary coil and the lower primary coil, but this is not limited thereto and the primary coil may be formed in one region corresponding to one surface of the secondary coil.

The upper primary coil 22 may be formed by laminating at least one layer 22-1 and at least one layer 22-2 which have the conductive pattern 22'. The conductive patterns 22' formed in the laminated layers 22-1 and 22-2 may be electrically coupled through a via electrode and the like. The conductive pattern 22' may be formed of a conductive metal and the like.

The lower primary coil 23 may be disposed within the magnetic core 110 to face a bottom of the upper primary coil 22. The lower primary coil 23 may be formed by laminating the plurality of layers 23-1 and 23-2 having the conductive pattern 23' like the upper primary coil 22.

The upper primary coil 22 and the lower primary coil 23 may be electrically coupled to each other through a via electrode. The conductive pattern 22' of the upper primary coil 22 and the conductive pattern 23' of the lower primary coil 23 may be configured of one curve through the via electrode.

The primary coil 21 including the upper primary coil 22 and the lower primary coil 23 may be coupled to a power source through the input terminal 135 and may receive a primary voltage.

The terminal pins 137 of the input terminal 135 may be fitted to the layers 22-1 and 22-2 and 23-1 and 23-2 constituting the upper primary coil 22 and the lower primary coil 23 and may be coupled to the conductive pattern 22' of the upper primary coil 22 and the conductive pattern 23' of the lower primary coil 23. The terminal pins 137 may be configured of a conductive metal and the like.

The turn ratio of the primary coil may be increased by coupling the conductive pattern 22' formed in the upper primary coil 22 and the conductive pattern 23' formed in the lower primary coil 23.

The secondary coil 24 may be configured of the plurality of layers 24-1 and 24-2 electrically coupled to the conductive patterns 22' and 23' of the primary coil 21 and the second conductive pattern 24' constituting the secondary coil may be formed in each of the layers 24-1 and 24-2.

The secondary coil 24 may be laminated to be disposed between the upper primary coil 22 and the lower primary coil 23. The secondary coil 24 may include the conductive patterns 24' formed in at least one layer 24-1 and at least one layer 24-2. The conductive patterns 24' formed in the laminated layers 24-1 and 24-2 may be coupled to each other through a via electrode and may be laminated to form a coil-shaped induction pattern.

The secondary coil 24 may be coupled to a circuit of the main substrate 10 through the output terminal 131. The conductive pattern 24' of the secondary coil 24 may be coupled to the main substrate 10 through the terminal pins 133 of the output terminal 131.

The secondary coil 24 may generate a low current of a high voltage through the electromagnetic induction action with the primary coil 21 and provide the low current of the high voltage to an electronic load device which requires a low current of a high voltage. The conductive pattern 24' of the secondary coil 24 may be formed of a conductive metal and the like.

The terminal pins 133 of the output terminal 131 may be fitting-coupled to the layers 24-1 and 24-2 constituting the secondary coil 24 and coupled to the conductive pattern 24' of the secondary coil 24. The terminal pins 133 may be coupled to a circuit of the main substrate 10. The terminal pins 133 of the output terminal 131 may be formed of a conductive metal and the like.

When the primary coil 21 and the secondary coil 24 are formed of one PCB by laminating the plurality of layers 22-1 and 22-2, 23-1 and 23-2, and 24-1 and 24-2 having the conductive patterns 22', 23', and 24', the thickness of the coil unit 120 may be reduced. The thickness of the coil unit 120 may refer to a height of the coil unit in a vertical direction. When the thickness of the coil unit 120 is reduced, the miniaturization and height reduction in the transformer 100 may be achieved.

The primary coil 21 and the secondary coil 24 of the coil unit 120 may be formed of the PCB in which the layers having the conductive patterns are laminated. Accordingly, the coupling coefficient between the conductive patterns 22' and 23' of the upper and lower primary coils may be uniformly realized and a coupling coefficient between the conductive pattern 24' of the secondary coil and the conductive patterns 22' and 23' of the upper and lower primary coils may be uniformly realized. The manufacturing of the upper and lower primary coils 22 and 23 and the secondary coil 24 may be automated and thus it may be advantageous for productivity improvement as compared with a manufacturing method of manually winding a wire and performing an insulation treatment.

The conductive patterns 22', 23', and 24' of the primary coil 21 and the secondary coil 24 may be configured of a metal foil such as a copper foil, a silver coil, and an aluminum foil or a conductive paste such as an ink in which a metal oxide is dispersed. When the conductive patterns 22', 23', and 24' are configured of the metal foil, the conductive patterns 22', 23', and 24' may be formed through a photolithography using a photomask and an etchant. When the conductive patterns 22', 23', and 24' are configured of the conductive paste, the conductive patterns 22', 23', and 24' may be formed through an electro-printing method such as a screen printing method. The conductive patterns 22', 23', and 24' may be formed in any one of a circular shape, an elliptical shape, and a polygonal shape having a starting point and an end point on the basis of the through hole 129 formed in the center of the coil unit 120.

The spiral conductive patterns 22', 23', and 24' may be formed in the plurality of layers 22-1 and 22-2, 23-1 and 23-2, and 24-1 and 24-2 constituting the primary coil 21 and the secondary coil 24. The number of windings (or turns) of the conductive patterns 22', 23', and 24' formed in the layers 22-1 and 22-2, 23-1 and 23-2, and 24-1 and 24-2 may be the same as each other, but all the conductive patterns 22', 23', and 24' may not necessarily have the same number of windings. For example, the number of windings in at least one of the conductive patterns 22' and 23' of the primary coil 21 may be controlled to match the total number of windings of the primary coil with a present value.

In the coil unit 120 according to an exemplary embodiment, the primary coil pattern and the secondary coil pattern may be formed in a PCB and thus the coil winding work may not be necessary and the size and volume of the device may be reduced due to the coil patterns printed on a plane.

The through hole 129 into which the middle foot of the magnetic core 110 is to be inserted may be formed in each of the layers constituting the coil unit 120.

As the coil unit 120 according to an exemplary embodiment may be formed by laminating and coupling the conductive pattern 22' and 23' of the primary coil 21 and the conductive pattern 24' of the secondary coil 24, the primary coil 21 and the secondary coil 24 may be sequentially laminated without the increase in the area of the PCB and thus the turn ratio of the coil surrounding the magnetic core 110 may be increased.

The layers 22-1 and 22-2, 23-1 and 23-2, and 24-1 and 24-2 forming the primary coil 21 and the secondary coil 24 may be laminated to constitute one laminating substrate. When the distance between the primary coil 21 and the secondary coil 24 is reduced, the leakage inductance may be reduced.

The transformer 100 according to an exemplary embodiment may be miniaturized and reduced in the number of processes by integrally manufacturing the coil with the PCB, without the pin arrangement for stably coupling the bobbin for the coil winding and the transformer, using the pattern design of the PCB other than the coil winding.

The coil 120 according to an exemplary embodiment may include the primary coil 21, the secondary coil 24, and a shielding layer 25 formed with a shielding pattern 25'. The shielding layer 25 may be laminated with the primary coil 21 and the secondary coil 24 to constitute a laminating substrate.

The shielding layers 25 may be formed between the upper primary coil 22 and the secondary coil 24 and between the lower primary coil 23 and the secondary coil 24. It has been illustrated that the shield layers 25 are formed in the upper side and the lower side of the secondary coil 24 in the laminating direction of the secondary coil 24, but this is not limited thereto and the shielding layers may be disposed between the plurality of layers 22-1, 22-2, 23-1, 23-2, 24-1 and 24-2.

The coil unit 120 according to an exemplary embodiment may include the primary and secondary coils 21 and 24 and an auxiliary coil 26 which generates and outputs an induced voltage through the electromagnetic induction action. The auxiliary coil 26 may be formed of at least one or more layers in the same shape as the coil patterns and laminated.

The induced voltage output from the auxiliary coil 26 may be used to drive an integrated circuit (IC) device and the like mounted on the main substrate 10. The auxiliary coil 26 may be coupled to the coil unit 120 through a via electrode. The auxiliary coil 26 may be coupled to the main substrate 10 through the input terminal 135.

The coil unit 120 may include the layers 22-1 and 22-2 and 23-1 and 23-2 formed with the conductive patterns 22' and 23' of the primary coil 21, the layers 24-1 and 24-2 formed with the conductive pattern 24' of the secondary coil 24, and the layer 26 formed with an auxiliary coil pattern 26' for forming an induction current.

The layer 26 formed with the auxiliary coil pattern 26' may be disposed close to the secondary coil 24. However, the laminating method of the auxiliary coil 26 is not limited thereto and the auxiliary coil 26 may be disposed below or over the primary coil 21 or may be disposed between the primary coils according to the needs.

Figure 4:
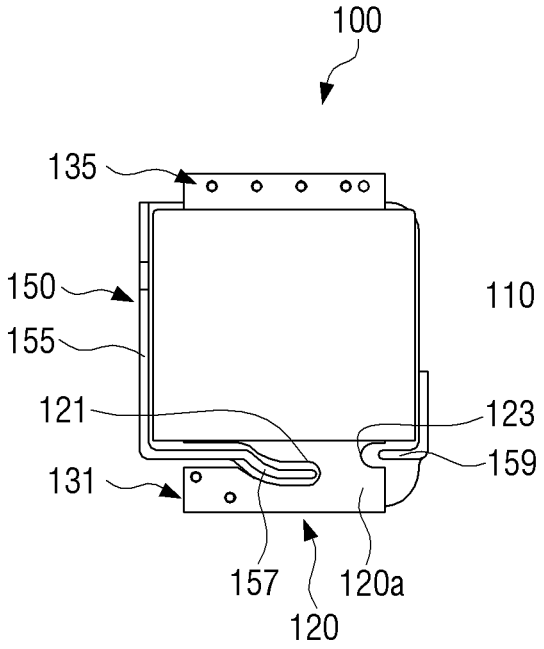
FIG. 4 is a plan view illustrating a transformer according to an exemplary embodiment.

FIG. 4 is a plan view illustrating a transformer according to an exemplary embodiment.

Referring to FIG. 4, the transformer 100 according to an exemplary embodiment may secure the creepage distance between the output terminal 131 formed in the one end of the coil unit 120 and the magnetic core 110 according to the structure that the base 150 is inserted into and coupled to the coil unit 120. For example, the insertion part 157 of the base 150 may be coupled to the coil part 120 in a protruding form toward an upper portion of the magnetic core 110. Accordingly, the insulation distance and the creepage distance between the magnetic core 110 and the output terminal 131 may be secured.

The primary coil and the secondary coil of the transformer may be formed in the board as an insulator and the creepage distance spaced at a fixed distance may be necessarily secured to maintain the insulation between the primary and secondary coils and the core of the transformer according to the security standards.

The creepage distance may refer to the shortest distance between two conductive portions and the shortest distance may refer to a distance measured along a surface of an insulating material located between the two conductive portions or along a portion coupling the two conductive portions.

The creepage distance between the magnetic core 110 and the output terminal 131 of the transformer 100 according to an exemplary embodiment may be secured through the insertion part 157 of the base 150 located between the magnetic core 110 and the output terminal 131 and thus the transformer 100 may be miniaturized.

The magnetic core 110 and the output terminal 131 may be formed to be isolated through the insertion part 157 of the base 150 inserted into the slit 121 of the coil unit 120. Accordingly, the shortest distance between the magnetic core 110 and the output terminal 131 may be measured along a surface of the insertion part 157. The coil unit 120 may secure the creepage distance without increase of a longitudinal width. The magnetic core 110 and the output terminal 131 may be isolated through the coupling of the base 150 and the coil unit 120 and thus the creepage distance may be easily secured. The good insulating performance between the magnetic core 110 and the coil may be exhibited according to the insertion coupling structure of the coil unit 120 and the base 150.

The insertion part 157 of the base 150 may be formed to be fitted to the slit 121 of the coil unit 120 in the transformer 100 and thus the assemblability may be improved by facilitating the simple assembly between the base 150 and the assembly of the magnetic core 110 and the coil unit 120.

The coupling part 159 of the base 150 may be fitting-coupled to the groove 123 of the coil unit 120 through the coupling of the base 150 and the coil unit 120 and thus the coupling stability between the base 150 and the assembly of the magnetic core 110 and the coil unit 120 may be secured.

The pattern part formed with the conductive patterns 22', 23' and 24' of the primary coil 21 and the secondary coil 24 and the output terminal 131 may be isolated through the insertion part 157. Accordingly, the effect of the voltage induced in the secondary coil 24 on an output voltage output through the output terminal 131 may be blocked through the insertion part 157.

Figure 5:
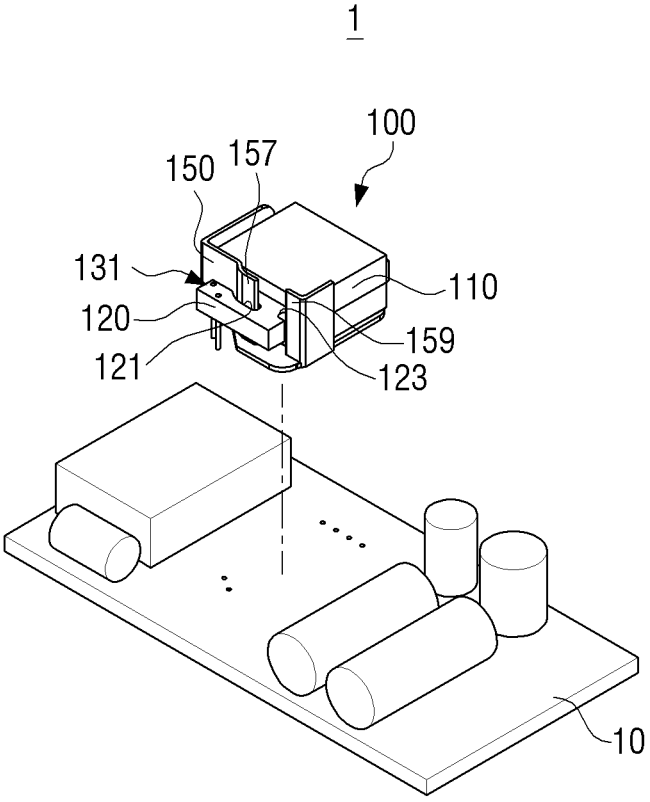
FIG. 5 is a schematic perspective view illustrating a figure of a transformer mounted on a circuit board in a power supply apparatus according to an exemplary embodiment.

FIG. 5 is a schematic perspective view illustrating a figure of a transformer mounted on a circuit board in a power supply apparatus according to an exemplary embodiment.

Referring to FIG. 5, the transformer 100 may be mounted on the main substrate 10 of the power supply apparatus 1. The output terminal 131 may be formed in the coil unit 120 which is drawn to the front of the magnetic core 110 and the output terminal 131 may include the terminal pin 133 so that the coil unit 120 may be mounted on the main substrate 10. The main substrate 10 and the primary coil 21 and the secondary coil 24 of the coil unit 120 may be coupled through the terminal pin 133. The inductor patterns in the coil unit 120 may be electrically coupled through the terminal pins 133 and 137. However, the main substrate 10 and the coil unit 120 may be coupled through soldering coupling in addition to the coupling using the terminal pin.

It has been illustrated that the transformer 100 is mounted horizontally on the main substrate, but this is not limited thereto and the transformer 100 may be mounted vertically on the main substrate 10.

The foregoing exemplary embodiments and advantages are merely exemplary and are not to be construed as limiting the present invention. The present teaching can be readily applied to other types of apparatuses. Also, the description of the exemplary embodiments of the present invention is intended to be illustrative, and not to limit the scope of the claims, and many alternatives, modifications, and variations will be apparent to those skilled in the art.

What is claimed is:

1. A transformer comprising:

a magnetic core having an upper core, a lower core and an inner space between the upper core and the lower core;

a coil unit disposed within the magnetic core and including a primary coil and a secondary coil in which layers formed with conductive patterns are laminated; and a base configured to receive the magnetic core and the coil unit and including a front opening, wherein a portion of the base is inserted into and disposed in the coil unit to be interposed between an output terminal coupled to the secondary coil and the magnetic core, wherein the coil unit includes a first part and a second part disposed on a bottom surface of the base, and wherein a portion of the coil unit is disposed in the front opening, and a width of the portion of the coil unit is smaller than a width of the second part of the coil unit.

2. The transformer as claimed in claim 1, wherein the coil unit includes:

the first part including the output terminal;

the second part including a pattern part formed with the conductive patterns and an input terminal coupled to the primary coil; and a slit configured to separate the first part and second part.

3. The transformer as claimed in claim 2, wherein the base includes a seating part in which the magnetic core and the coil unit are placed and at least one sidewall formed to protrude from the seating part, and the sidewall includes an insertion part inserted into and coupled to the slit.

4. The transformer as claimed in claim 3, wherein a height of the insertion part is formed higher than a height of the magnetic core.

5. The transformer as claimed in claim 3, wherein the insertion part forms a present creepage distance between the output terminal and the magnetic core.

6. The transformer as claimed in claim 2, wherein the slit is formed to be curved to a direction of the first part.

7. The transformer as claimed in claim 3, wherein the insertion part is formed as a portion of the sidewall.

8. The transformer as claimed in claim 3, wherein the coil unit further includes a groove formed apart from the slit.

9. The transformer as claimed in claim 8, wherein the sidewall further includes a coupling part fitting-coupled to the groove.

10. The transformer as claimed in claim 1, wherein the coil unit further includes an auxiliary coil for forming an induced current.

11. The transformer as claimed in claim 1, wherein the conductive patterns of the primary coil are disposed in an upper side and a lower side of the conductive pattern of the secondary coil.

12. A power supply apparatus comprising:

a transformer including a magnetic core having an upper core, a lower core and an inner space between the upper core and the lower core;

a coil unit disposed within the magnetic core and including a primary coil and a secondary coil in which layers formed with conductive patterns are laminated; and a base configured to receive the magnetic core and the coil unit and including a front opening, wherein a portion of the base is inserted into and disposed in the coil unit to be interposed between an output terminal coupled to the secondary coil and the magnetic core; and a main substrate mounted with the transformer, wherein the coil unit includes a first part and a second part disposed on a bottom surface of the base, and wherein a portion of the coil unit is disposed in the front opening, and a width of the portion of the coil unit is smaller than a width of the second part of the coil unit.

13. The transformer as claimed in claim 1, wherein the first part and the second part are spaced apart horizontally, and a portion of the base is disposed between the first part and the second part.

14. The transformer as claimed in claim 1, wherein the portion of the base is disposed between the first part and the second part, and the first part and the second part are physically connected to each other.

* * * * *